US008984809B1

(12) United States Patent
Miller et al.

(10) Patent No.: US 8,984,809 B1
(45) Date of Patent: Mar. 24, 2015

(54) PHOTO EYE TO SWITCH SENSING EDGE CONTROL CONVERSION SYSTEM

(71) Applicant: Miller Edge, Inc., West Grove, PA (US)

(72) Inventors: Bearge Miller, West Chester, PA (US); Timothy Castello, West Chester, PA (US); John Provenzano, Hatfield, PA (US); Vinay Sao, Malvern, PA (US)

(73) Assignee: Miller Edge, Inc., West Grove, PA (US)

( * ) Notice: Subject to any disclaimer, the term of this patent is extended or adjusted under 35 U.S.C. 154(b) by 0 days.

(21) Appl. No.: 14/120,511

(22) Filed: May 28, 2014

Related U.S. Application Data

(62) Division of application No. 13/136,633, filed on Aug. 5, 2011, now Pat. No. 8,769,878.

(60) Provisional application No. 61/401,034, filed on Aug. 6, 2010.

(51) Int. Cl.
*E05F 11/00* (2006.01)
*E05F 15/20* (2006.01)
*E05F 15/00* (2006.01)

(52) U.S. Cl.
CPC ..... *E05F 15/2023* (2013.01); *E05F 15/203* (2013.01); *E05F 15/0026* (2013.01)
USPC ..... 49/199; 49/25; 49/28

(58) Field of Classification Search
USPC ..... 49/26, 27, 28, 197, 199; 200/61.43
See application file for complete search history.

(56) References Cited

U.S. PATENT DOCUMENTS

| | | | | |
|---|---|---|---|---|
| 6,020,703 | A * | 2/2000 | Telmet | 318/480 |
| 6,111,374 | A * | 8/2000 | Fitzgibbon et al. | 318/282 |
| 7,228,883 | B1 * | 6/2007 | Murray | 160/201 |
| 7,342,368 | B2 * | 3/2008 | Roman | 318/285 |
| 7,688,014 | B2 * | 3/2010 | Tang et al. | 318/466 |
| 8,495,834 | B2 * | 7/2013 | Harlow et al. | 49/28 |
| 8,769,878 | B1 * | 7/2014 | Miller et al. | 49/506 |
| 2004/0155771 | A1 * | 8/2004 | Ergun et al. | 340/531 |
| 2009/0113797 | A1 * | 5/2009 | Hoermann | 49/26 |
| 2009/0272035 | A1 * | 11/2009 | Boisvert et al. | 49/28 |
| 2012/0174483 | A1 * | 7/2012 | Harlow et al. | 49/26 |
| 2013/0111813 | A1 * | 5/2013 | Rozgonyi | 49/27 |

* cited by examiner

*Primary Examiner* — Jerry Redman
(74) *Attorney, Agent, or Firm* — Robert B. Famiglio; Famiglio & Associates

(57) ABSTRACT

An apparatus and method to adapt an automatic door motor operator utilizing a photoelectric eye generating a digital pulse train of known amplitude, periodicity and duty cycle to a control signal created through the opening or closure of a moving door edge sensing device or strip which closes or opens when compressed. The invention relates to safety edges used on motorized doors to provide a conversion means to allow a sensing edge switch on the leading edge of a moving door to control a door operator control unit which expects to receive a control signal of a predetermined amplitude, period and duty cycle normally generated through use of a photo eye used to monitor obstructions within the path of the moving door. The invention allows field replacement of an obstruction protecting photo-eye sensor with an safety edge switch type device utilizing the existing door operator and the in-place power source.

3 Claims, 3 Drawing Sheets

PHOTO EYE TO SWITCH SENSING EDGE CONTROL CONVERSION SYSTEM

CROSS REFERENCE TO RELATED APPLICATIONS

This application is a divisional application of the applicant's parent U.S. Pat. No. 8,769,878 filed Aug. 5, 2011, which itself claims the benefit of the applicant's provisional patent application No. 61/401,034 filed on Aug. 6, 2010.

BACKGROUND OF THE INVENTION

1. Field of the Invention

The invention relates to an electronic control system for an automatic motorized door operating unit to allow a switching safety edge to operate with a motorized door operating unit of the type which is designed for use with a photo eye obstruction detection system.

2. Description of the Related Art

Motorized doors are used for everything from residential garages to industrial moving, rolling or sliding doors and gates. For many years, it has been a best practice and usually a legal safety requirement to provide an obstruction protection mechanism to stop a motorized door moving along a given track when the door has an obstruction that will strike the door if the motor driving the door is not stopped. Many automatic doors or gates, particularly those such doors used in industry, have a door operating unit which controls the power to the door motor to open or close the motorized door along its normal path.

In many cases, light beam sensors such as a photo eye are used to monitor the continuity of an infrared light beam installed across the path of the motorized door so that obstructions to the door can be sensed by the breaking of the photo eye path thereby changing the always on, fail safe control signal which would normally be signaling continuously that the path of the door is not obstructed. A problem with such photo eyes is that they are by inherent design observing obstructions, or the lack thereof, only across the actual path of the light beam from a light emitter to a photo eye on the opposite side of the path. There are other disadvantages to a light beam obstruction sensor as well. Therefore, a moving edge of a door being closed may meet an obstruction that is outside the sensing range of a given photo eye pair therefore causing the door to strike the obstruction whether it is a vehicle, person or other object in the path of the moving door.

Door or gate edge sensors are known devices which are comprised of elongated conductive switches which are contained within an enclosed switch package which can be placed along the entire leading edge of a moving door. Such edge safety switch devices are commonly known as switch safety edges, safety switches, edge switches, switch sensing edges or just sensing edges. The switches operate by being compressed when striking an object thereby shorting parallel flexible conductors within the edge sensing strip to close a conduction loop or path to a control circuit. This action then indicates that the edge has struck an obstruction and therefore the motor should be de-energized.

Edge sensing strips or switches may also have fail safe configurations such that each side of a two-conductor elongated strip is checked for continuity to make sure that any operation of the switch because of an obstruction will actually allow a signal of continuity engagement to be transmitted back to a control module which is monitoring for an opened or closed condition in the edge sensing strip. This presents a continuous signal opportunity much as a photo-eye monitored door so that the motor operator for controlling the door is signaled that the obstruction protection remains operational. Such door operators otherwise default to a safe condition if the operator does not receive a signal from the photo-eye. Likewise, an edge switch must present monitored status by continuity checking in some fashion. Some monitored switching systems are sometimes referred to as 4-wire switches in which simple direct current continuity confirmation is accomplished by simple means. Other monitoring means might include placing a known component, such as a resistor of known value, in the switch edge to facilitate a known or expected measurement of the component, a change if which can be used to signal a change in the switch edge state from functioning to non-functioning.

Conventional, simple photo eye obstruction sensors generate a continuous signal output when no obstructions are blocking the path between light generator and the light beam receiver on the opposite end of the protected path. Photoelectric systems typically use a signal waveform with a designed and controlled amplitude, period and duty cycle, tailored to a particular door operator unit designed to work with a particular controller with a given style of signal output from a given photo eye system. In order to make an edge sensing switch compatible with a given door operator unit which expects to see a signal from the photo eye, a programmable and flexible interface device would be necessary to convert the expected direct current switching information from a 2 or 4-wire safety switching edge to the type of output signal a door operating unit would expect to see if it were observing a simple photo eye across the protected door entrance. Generating a signal expected as output from a functioning photo-eye system based on a retrofitted switch edge device would allow conversion of an existing installation of an automatic door controller which is using a photo-eye obstruction sensor to an edge switch sensor without the need to change the system components. It is also important to accomplish such a conversion utilizing the existing power provided by the motor operator, typically 24 volts for a photo-eye controlled operator.

Accordingly, a device and method is needed in which the user of a motorized door safety sensing system can use edge sensing switch devices to drive a motor controller which normally is expecting to see a digital signal from a compatible photo eye device commonly used in the industry. A system which allows retrofitting of existing door operating units which use conventional photo eye control signaling by providing an interface between the conventional switch sensing edge to the digital control signal emulating the output of a simple photo eye which otherwise would be used with a given control unit to protect from obstructions placed within the pathway of the moving motorized door would allow this and be useful. Such a conversion must maintain the safety conditions afforded by monitoring the operational readiness of the retrofited switch edge when in standby mode.

Accordingly, it is the object of the present invention to provide an interface device which will allow retrofitting a motorized door operating unit from a simple photo eye obstruction sensor to a door edge sensing switch device which uses either a 2-wire or 4-wire continuity control system without changing or modifying the door operating unit already in place.

It is further the object of the present invention to provide a conversion device to change an opened or closed direct current switch condition in a door edge sensing device to a pre-determined digital signal output of a selected amplitude, periodicity and duty cycle to suit a given motorized door operating unit which would otherwise expect to be signaled by a defined digital signal emulating the output of a compatible photo eye sensing device and operate from the existing control voltage provided by the door operating unit.

It is also the object of the present invention to provide a method of retrofitting an existing photo eye type obstruction protection controller to use a door edge switch obstruction protection system without the requirement of changing the controller or applying different power requirements.

SUMMARY OF THE INVENTION

The Underwriter's Laboratory® ("UL") standard for safety entrapment devices used on commercial doors and gates has been changed recently. While compliance to the standard is voluntary, the majority of commercial door and gate operators are modifying their products in order to be in compliance with the new standard. The most significant change to the standard requires door operators (the mechanical linkages, motors and control circuits) to have a "monitored" external entrapment device. The term "monitored" defines a device that generates a unique signal such that the monitoring equipment, i.e. the operator, can determine that the device is connected and working properly. A monitored entrapment device for motorized doors therefore applies a fail-safe protocol to assure that the safety device itself is always operational, and stops the system if the safety device reports a failed condition of the device.

In the field of door and gate operators the simplest monitored device that meets the UL requirements is a "monitored photo-eye". Photo-eyes are available as both monitored and un-monitored varieties. Typically, a monitored photo-eye designed to function with a UL-325 compliant operator generates a square wave output signal with a frequency range from 300 Hz to 1000 Hz and a duty cycle of roughly 85% (High to Low ratio). Virtually all of the operator manufactures that build UL-325 compliant equipment made a decision to use a monitored photo-eye as their external entrapment device likely because of the relatively low cost. A safety edge switch type device could be used but only as an auxiliary device in conjunction with a monitored photo-eye. Thus the end user was required to purchase and install two entrapment devices in order to gain the superior protection of a safety edge switch such as offered by certain manufactures.

In order to solve this problem, it would be desirable to design a monitored safety edge that would generate the exact same signal as a monitored photo-eye and would look identical in operation to the operator to which it was connected. The optimum design would be a system consisting of a terminated edge switching device and a conversion module which serves as a solution to the described problem. Both a method and a system of retrofitting existing installations would be very advantageous.

A terminated edge switch is a elongated door edge switch which may include a type of terminating device, such as a resistor or a diode or a capacitor, connected to the switching type edge at the end opposite to the cable exit end. Four wire switching edges, wherein the extra wires are used to monitor continuity of the switch elements without a terminating device are still in use. The present invention can still be utilized in such a case. An existing four wire edge can be converted to a terminated edge by simple connecting the terminating element between one pair of the wires coming from the edge.

When the terminated edge is connected to the module described in this disclosure, the act of monitoring is carried out by the internal microprocessor. The microprocessor in the invention is configured to test the edge hundreds of times per second to insure that the termination is present. When the edge is activated by closure of the conductors which comprise the length of the switch, the electrical characteristics or value of the terminating device is effectively interrupted and the control then observes a short or closed conductor condition rather than the monitored value of the terminating device. When an obstruction is sensed, a microprocessor interrupts the output signal to the operator which causes the door to stop, reverse and go to the fully open position as such an operator normally reacts according to its design and/or programming.

In summary, the apparatus and method described both monitors a door or gate switch edge for its termination and checks the edge for activation. The invention controls the door operator in the same fashion as if the replaced photo-eye sensor was monitoring the same door and therefor eliminates the need for a new door operator or new power supply for the switch or the control module disclosed as the module will operate on the same voltage used to power the replaced photo-eye. A failed termination device or other change of the electrical conditions of the switch because of failure or an activation of the switch result in the loss of signal to the operator and the door stops and/or opens depending on the programmed set up of the door operator. The invention is a field replacement system for an existing photo-eye monitored automatic door which functions with the existing monitored door operator.

DETAILED DESCRIPTION OF INVENTION

Figure 1:
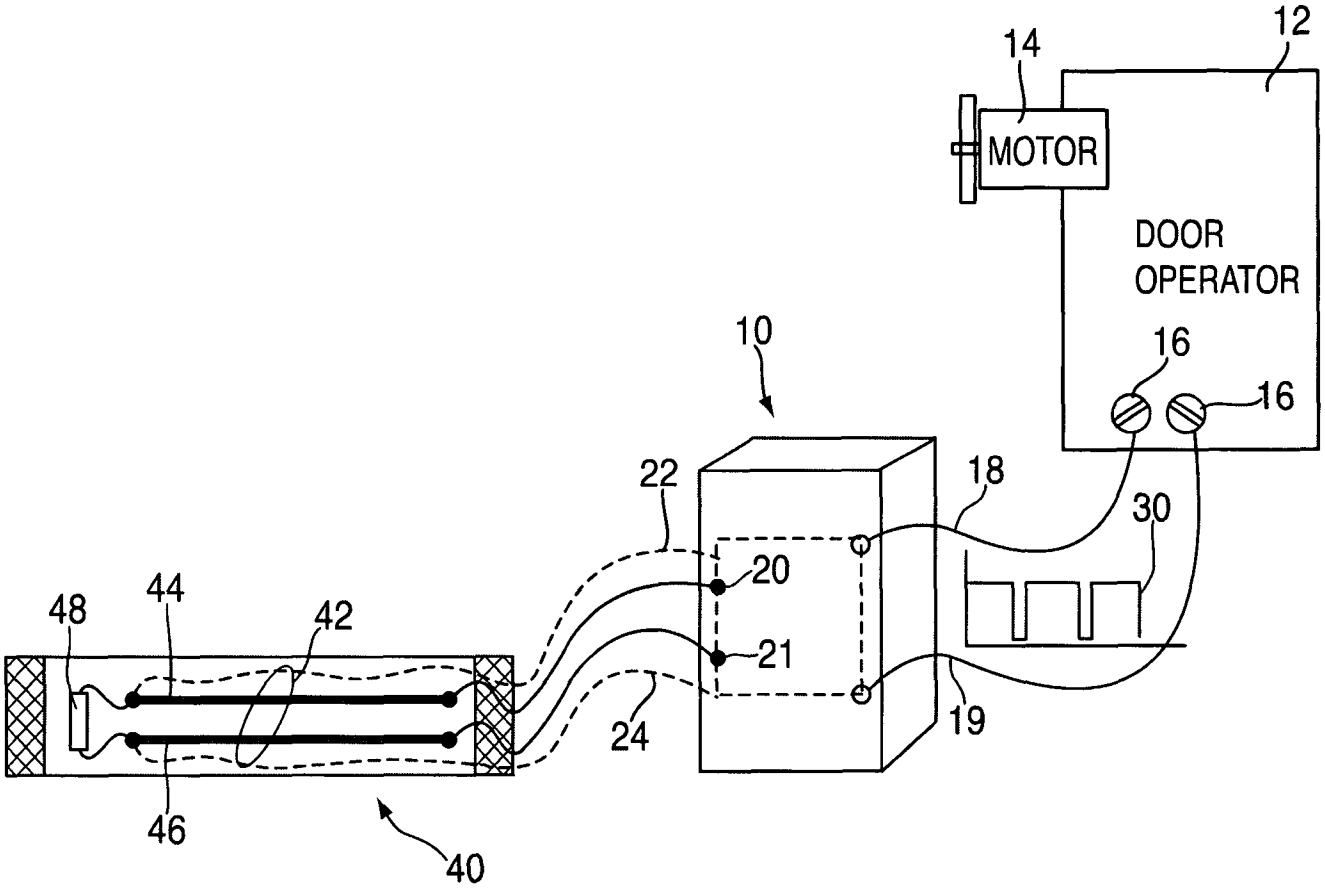
FIG. 1 is a system pictorial diagram demonstrating the placement of the interface module containing a microprocessor between an edge sensing switch on a moving door or gate which is retrofitted from a simple photo eye obstruction monitoring device.

And now the invention will be described in detail with reference to the various drawings in which like numerals refer to like parts. Turning to FIG. 1, a pictorial diagram of the system presents the general placement and operation of control module 10. In most automatic door operating systems, there is a door operator 12 which controls motor 14 which can drive a gate, overhead door or other automatic door opening system.

Many present systems utilize a photoelectric eye of either visible light, infrared light beams or other obstruction sensing photoelectric or similar devices are known to those skilled in the art. Such devices monitor the threshold of such automatic doors or gates to stop the door operating unit 12 in the event that motor 14 is driving the automatic door but an obstruction appears in its path. Such photoelectric devices and other beam sensing systems operate by providing a signal of known amplitude, period and duty cycle output 30. Output 30, depicted in the figure as square wave pulses in diagrammatic representation, is presented across operator photoelectric input 16 as shown in FIG. 1. As long as door operator 12 receives the expected signal 30 across input terminals 16, shown in the figure as two wire terminals, operator 12 will continue to operate normally upon a command to open and close by activating motor 14 when a request is received by whatever control means is used. Such control means could be a button, or a wireless remote door control or the like.

Without the presence of signal 30, operator 12 would assume that there has been a failure of the photoelectric safety system or an obstruction and will prevent operation of motor 14. Any replace device must therefore both function from a typical 24 volt control voltage available across input terminal 16 and simulate the normal state signal output expected by operator 12 to truly be a retrofit capable system.

As described above, there is a need to substitute photoelectric devices with actual edge safety sensing systems which in many applications are an advantage from the perspective of being able to sense obstructions in front of the automatic door being operated by motor 14. Sensing edge 40 is an elongated switch that run across the entire length of a typical automatic door or gate, compressing slightly when contacting an obstruction in the path of the automatic door. Sensing edge 40 is a switch design already known to those skilled in the art in the sense that such switches have been employed as a safety feature on many operating doors in the past.

Edge 40 operates differently than a typical photoelectric beam that may sweep the same threshold being protected in that edge 40 is a simple switch which is comprised of a flexible switch assembly 42. Assembly 42 is comprised of elongated conductors such as foil sandwiched along the top of the strip at 44 with a bottom strip 46 essentially presenting a second conductor which can close a circuit upon compression of switch foil 44 into switch foil 46 when coming in contact with an obstruction. Accordingly, a circuit can be closed allowing a simple control type unit to switch off a door operator which is expecting a different type of signal input, (that is, an open or closed continuity condition) than those used for simple photo eyes. However, it can be appreciated that to be considered a monitored system, the simple continuity style switch must have facilities to reliably signal failure of the switch components.

Edge 40 can be constructed of different types of switch assemblies 42 to allow for actual monitoring of the continuity of foil 44 and 46 so that if they become open through wear and tear a simple system can sense that edge 40 is no longer protecting a door edge to which it is attached. A preferred method presently is the use of a terminating device 48 which is typically a resistor, diode and capacitor combination or other device which allows control models that are typically used for sensor edge 40 to measure an expected resistance across foil 44 and foil 46 thereby allowing a control module for a simple sensing edge to detect that it is no longer measuring the terminating resistor, typically 10,000 Ohms or, if diode and capacitor terminated, the direct current termination expected as device 48. Direct current termination can take the form of a back to back diode such as a commonly known P6KE9.1CA in connection with a conventional capacitor placed in parallel across the diode. When the state of edge 40 changes because that the foil switch has failed in some aspect and is no longer in a protection mode, it can be appreciated that the resistance or voltage drop across terminals 20 and 21 will change. Module 10 measures this and will terminate the signal generated across terminals 18 which provide the constant state signal 30 to operator 12 as shown.

Another older method of measuring continuity of foil 44 and foil 46 which may still be in use is to replace terminating device 48 with a four-wire conductor as shown in FIG. 1 which is comprised of the two conductor terminals from assembly 42 with the addition of sensing wires 22 and 24 which themselves can measure the continuity of foil 44 and 46. By sensing continuity between terminal 20 and 22 shown on FIG. 1, one can determine whether foil 44 is in operation. Likewise, sensing continuity between terminal 21 and 24 in FIG. 1 will indicate that switch foil 46 is likewise intact. This system of fail safe checking the integrity of flexible switch assembly 42 may still be in use but is presently losing popularity as a preferred switch monitoring technique. Voltage generation for continuity checking is not shown but is easily constructed using conventional techniques and can be intergrated into the module using the 24 volt control voltages typically used and presented by motor door operator 12 if desired.

To employ sensing edge 40 in a retrofit installation to replace a photoelectric eye which may be monitoring a threshold of a moving door, it can be appreciated that door operator 12 must receive an expected signal 30 across terminals 16 in order to allow door operator 12 to continue to operate normally as if a photoelectric threshold sensor that is being replaced is still in operation and is signalling that all is well with the safety sensing photoelectric device.

Accordingly, module 10 is a microprocessor based device which converts the simple continuity information available from edge 40 to a preprogrammed output of known amplitude, period and duty cycle at signal 30 to present to operator photoelectric signal input 16. In such a fashion operator 12 continues to receive and expect a signal indicating that any threshold safety system is in operation and is therefore fail safe allowing the retrofitting of a photoelectric system with a sensing edge 40 without the need to change door operator 12 or other system components.

Module 10 as shown in FIG. 1 contains a control circuit such as presented in block diagram form in FIG. 2 and in more detail with an example in FIG. 3 which can be adopted for direct current terminated switch edges or resistor terminated edges as may be desired in the installation of sensing edge 40, discussed in more detail below. Module 10 is connected to flexible switch assembly 42 at terminals 20 and 21 and may include monitoring sensor wires shown at 22 and 24 to assure continuity of switch foil 44 and switch foil 46. It can be appreciated that if terminating device 48 is going to be a resistor, for example, it is not necessary to also employ wire 22 and 24 for continuity since module 10 would be designed to measure the resistance of device 48 to determine whether assembly 42 is operationally ready.

Module 10 is comprised of terminal outputs 18 thereby providing an expected signal to door operator 12 without the need to change the entire door operator and associated systems when converting an existing photoelectric safety system to an edge sensing switching arrangement as described above.

Figure 2:
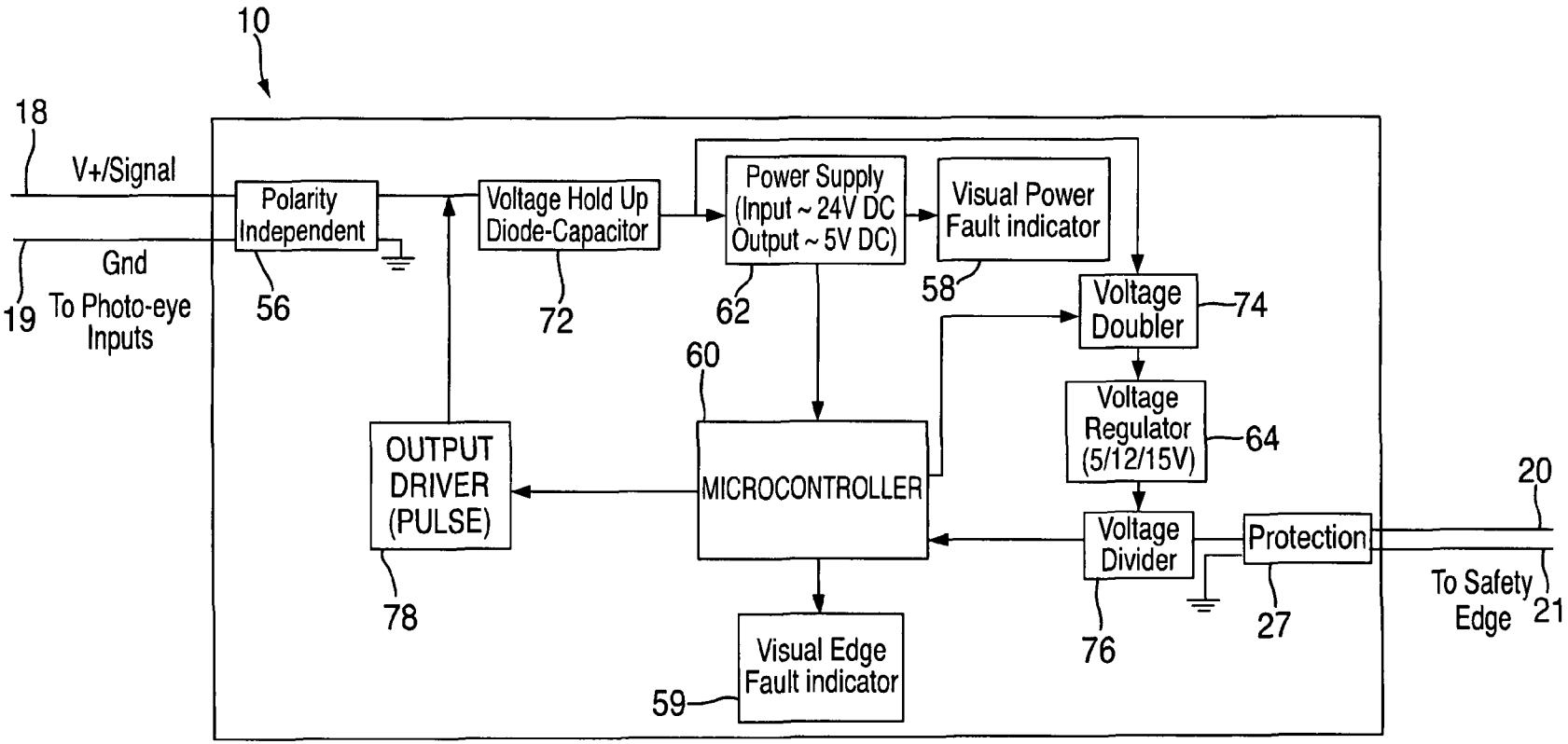
FIG. 2 is an electronic block diagram of a preferred embodiment of the interface module demonstrating the overall design method of the interface module for use in replacing an electric photo-eye with an edge sensing switch.
Figure 3:
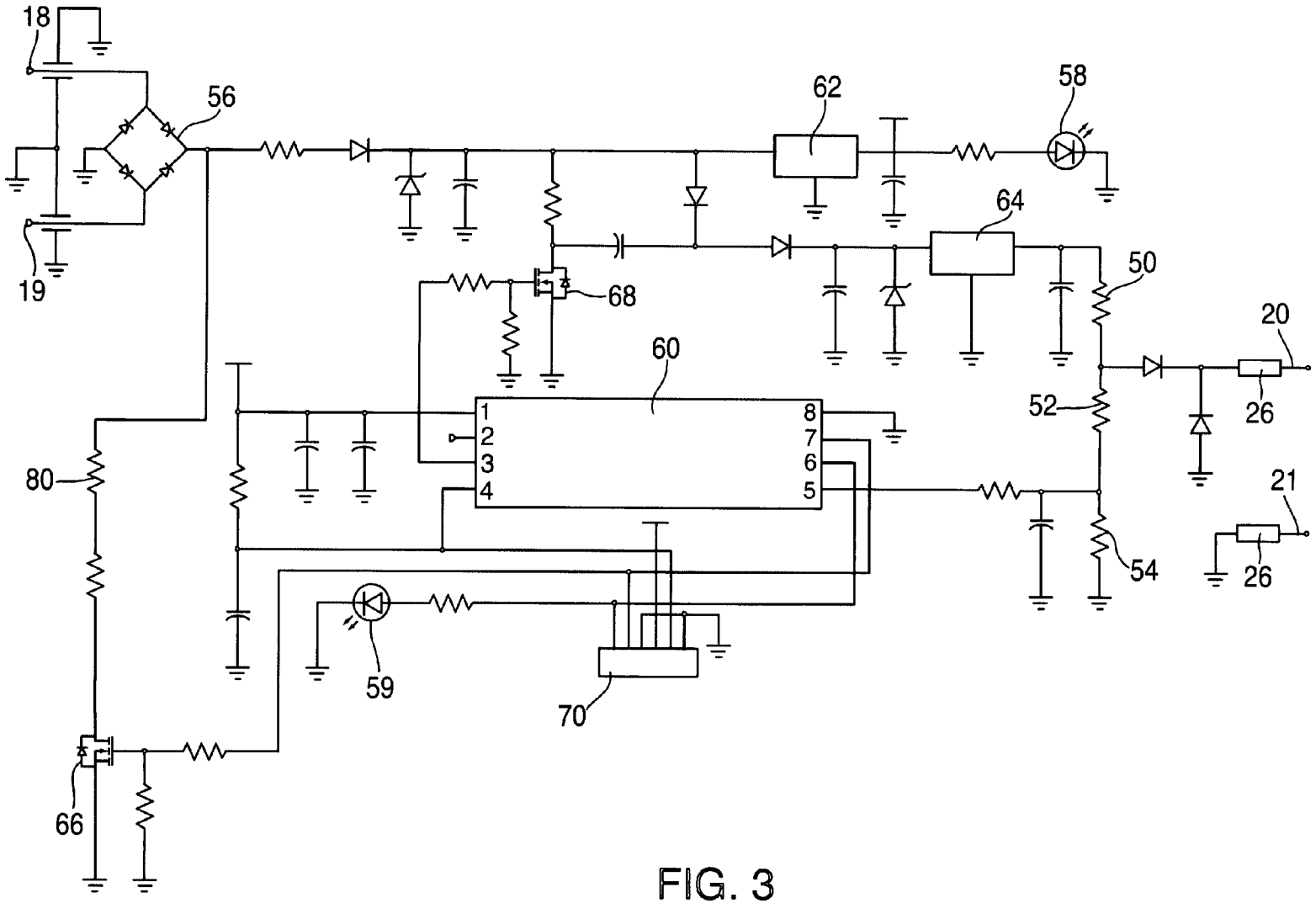
FIG. 3 is an electronic circuit schematic diagram with details of an embodiment for the module interface which is used to interface between a device terminated edge sensing switch and photo eye terminals of a motorized door operating unit.

Turning to FIG. 2 now, a block diagram of the electronics implemented in FIG. 3 is shown. Power supply 62 consists of 5 volt voltage regulator (shown as regulator 62 in FIG. 3) and associated discrete components. Regulator 62 and 64 are commonly known as an LM3480-5V. However, regulator 64 is commonly known as an LM3480-15/12V when module 10 is configured for a DC termination 48 as described below. Module 10 can have an input voltage range across terminals 18 and 19 of 6 Volts DC to 30 Volts DC with a source resistor of 300 ohms to 800 ohms. The input voltage from operator 12 is polarity independent. Diode bridge 26 creates polarity independence providing simpler installation and preventing polarity errors. Voltage hold up circuit 72 maintains the stability of the voltage going to voltage regulator 62 (shown in schematic form in FIG. 3) since the input voltage is pulsed by output driver 78 when a properly terminated edge 40 is connected and prevents the input voltage to regulator 62 from going to zero volts. Power to module 10 is indicated by a green LED 58.

Voltage doubler 74 functionality is used when module 10 is used with a direct current type termination device 48. Voltage doubler 74 is bypassed when module 10 is used with a resistor termination device 48. Use of a direct current type terminated edge 40 requires at least 12 volts to monitor edge 40. However, the incoming voltage in case a diode and capacitor type direct current termination 48 is only between 10 volts and 12 volts, so incoming the voltage from door operator 12 needs to be boosted. Therefore, when a direct current termination of switch edge 40 is used, the 12 volt or 15 volt regulator is used and in the case of a resistor terminated device 48, a 5 volt regulator is used.

Voltage divider circuit 76 divides the incoming voltage from edge 40. Two different resistor divider networks are used in module 10. One resistor network is used for the case in which termination device 48 is of the direct current type, and a second set is for use if termination device 48 is a resistor. Protection circuit 27 prevents damage to module 10 should an installer mistakenly connect switch edge terminals 20 and 21 to operator output terminals 18 and 19.

Micro-controller 60 and output pulse driver 78 comprises the control block of module 10. Micro-controller 60 performs two functions. Micro-controller 60 monitors edge 40 and if a properly terminated edge 40 is connected, micro-controller 60 toggles output pulse driver 78, and controls red LED 59 to indicate edge fault. Micro-controller 60 monitors the output voltage of voltage divider 76. If the voltage is between the specified voltage ranges then the pulse is generated and turns off red LED 59. If the voltage is above the specified range then a pulse is not generated, resulting in red LED 59 being turned on. If the voltage is below the specified range then it doesn't generate the pulse red LED 59 is cycled through on and off to blink the LED. Use of a direct current terminating device 48 or a resistor termination device 48 result in different voltage ranges and pulse rate outputs. Output pulse driver 78 is controlled by the micro-controller. It toggles the input voltage line by field effect transistor ("FET") 66 shown in FIG. 3. It also has positive temperature coefficient (PTC) device 80 in the case of a direct current termination device 48. PTC device 80 prevents FET 66 in the case of sudden surge of input current. Both FET 66 and FET 68 shown in FIG. 3 are both commonly known as type number 2N7002ET1G.

In carrying out the invention it can be appreciated by those skilled in the art there would be a number of ways to implement control circuits for module 10. FIG. 3 shows a preferred embodiment of a typical electronic circuit which comprises module 10 for use for a direct current terminated edge 40 which utilizes the four-wire connection described above presenting operational continuity confirmation by measuring continuity between terminal 20 and line 22 and terminal 21 and line 24. In the preferred embodiments, FIG. 3 illustrates a typical electronic design for module 10 for terminated switch assemblies 42 with a resistor as device 48 or utilizing a diode and capacitor pair for termination. One difference would be adjustment of the values of resistors 50, 52, 54 in FIG. 3.

In FIG. 3, micro-controller or microprocessor 60 can be programmed to provide a signal output which is designed to match a particular motor controller system which may already be in place in a given installation. Jack 70 is used to program or service module 10. One type of device employed effectively in the design is a Microchip Technology, Inc. model PIC12F683 micro-controller which is readily available. Once the expected signal input for a given photo eye output to an operator or controller is determined, a microprocessor device can be programmed to emulate the waveform or control information which the operator expects to see from a photo eye signal output.

Thereafter, an edge switching system connected to terminals 20 and 21 in both circuit examples can be used to control a motor operator or control system by discontinuing or altering the control signal which the operator circuit would expect to see for an unobstructed path. When an edge switching device is activated because it has hit an obstruction, the circuit examples presented will discontinue the emulated photo eye signal output expected by a given motor controller simulating the control signal disruption of a photo eye circuit for a similar obstruction. The control circuit disclosed provide typical component type and placement and identify typical terminal uses on the microprocessor device suggested, but different embodiments can be used to accomplish the purpose of the invention once the desirable end result is determined.

Programming a microprocessor, micro-controller or another type of peripheral interface controller device can be accomplished by loading firmware into the device which allows the flexibility of the invention to address the control requirements of a given photo eye driven motor control device. Such programming for generating an output signal of a desired pulse size, periodicity, amplitude or other characteristics is known to those skilled in the art. Accordingly, various similar methods could be designed to carry out the solution taught in this disclosure. Such solutions which allow the same result are within the scope of the present invention. It can be appreciated by those skilled in the art that the samples of the circuit diagrams given are a good solution to provide the control desired. However, other changes and circuit selections could be designed to accomplish the same conversion of control information to allow various styles of switching devices to operate with a motor controller or operator which expects to see a certain control information pattern of a selected frequency, period, pulse rate or pulse length.

Although the invention has been described in accordance with the preferred embodiment, it will be appreciated by those skilled in the art that the application of the present invention is useful in a variety of configurations and designs not specifically described above. All such designs and applications are considered to be within the scope of the present disclosure, and the invention is applicable across a wide variety of applications. Such applications are considered within the scope and spirit of the present invention.

What is claimed is:

1. Apparatus for converting a door operator which controls an automatic motorized door utilizing photo eye obstruction sensing to provide a signal to said operator of an obstruction of the door being controlled, said signal being of a given amplitude, periodicity and duty cycle, to operate with a switch sensing edge which switches between an open or closed condition dependent on the switch sensing edge contacting an obstruction, switch sensing edge being placed along an edge of the door, said apparatus comprised of:

means to connect the switch sensing edge to the apparatus;

means to sense an open or closed condition of the switch sensing edge;

means to monitor the switch sensing edge continuously to determine whether the switch is connected to the apparatus and in an open or closed state of continuity;

means to convert the electrical power available from the door operator for use with said switch sensing edge and the apparatus;

output means for generating the periodic signal of a desired amplitude, period and duty cycle to correspond to the amplitude, period and duty cycle of the signal from a photo eye obstruction sensor which the apparatus is replacing;

whereby the apparatus senses an open or closed condition of the said edge sensing switch and converts an open or closed condition input condition of the switch to said signal of the desired amplitude, period and duty cycle which simulates the signal which would be expected by the door operator if said operator was operated by the said photo-eye obstruction sensor.

2. Apparatus for converting a door operator which controls an automatic motorized door which utilizes photo eye obstruction sensing to signal said operator of an obstruction to the door being controlled, said signal being of a given amplitude, periodicity and duty cycle, to operate with a switch sensing edge placed along an edge of the door, said apparatus comprised of:

polarity independent connection means to connect the door operator to the apparatus without regard to electrical polarity;

voltage hold up means to buffer the output voltage of an output driver;

an output driver to provide an output pulse to match said given amplitude, periodicity and duty cycle of the door operator;

power supply means to convert the power available from the door operator for use with the apparatus;

a microcontroller programmable to create a signal to said output driver to match said amplitude, periodicity and duty cycle of the door operator;

wherein said apparatus is connected to said switch sensing edge and provides a signal to the door operator which simulate a signal which would be provided to the door operator from a photo-eye obstruction sensor.

3. Apparatus for use with a door operator which controls a motorized door, the door operator utilizing a photo eye obstruction sensor which stops the operation of the motorized door when the photo eye obstruction sensor senses an obstruction thereby discontinuing a continuous signal to the door operator, said continuous signal being a signal of a given amplitude, periodicity and duty cycle, the apparatus allowing substitution of a switch sensing edge which switches between an open or close condition dependent on the switch sensing edge contacting an obstruction and providing an obstruction indication to the door operator such as to allow interchangeability between a photo eye sensor and a switch sensing edge, the apparatus comprised of a connection to a switch sensing edge;

a microcontroller-based signal generator which provides a signal identical to the amplitude, periodicity and duty cycle of the photo eye obstruction sensor which is being replaced by the switch sensing edge;

said connection to said switch sensing edge providing an electrical path from the said sensing edge to said microcontroller-based signal generator; and an output driver connected to the door operator input previously used for the photo eye which is being replaced.

* * * * *